US010952508B2

(12) United States Patent
Barrah

(10) Patent No.: US 10,952,508 B2
(45) Date of Patent: Mar. 23, 2021

(54) DECORATIVE COVER FOR NAILS, TACKS AND SCREWS

(71) Applicant: Sarah Barrah, Carlsbad, CA (US)

(72) Inventor: Sarah Barrah, Carlsbad, CA (US)

( * ) Notice: Subject to any disclaimer, the term of this patent is extended or adjusted under 35 U.S.C. 154(b) by 0 days.

(21) Appl. No.: 16/796,772

(22) Filed: Feb. 20, 2020

(65) Prior Publication Data

US 2020/0288818 A1 Sep. 17, 2020

Related U.S. Application Data

(60) Provisional application No. 62/818,301, filed on Mar. 14, 2019.

(51) Int. Cl.
*A44B 1/14* (2006.01)
*A47G 1/16* (2006.01)

(52) U.S. Cl.
CPC . *A44B 1/14* (2013.01); *A47G 1/16* (2013.01)

(58) Field of Classification Search
CPC ..... A47G 1/16; A47G 3/00; A44B 1/14
See application file for complete search history.

(56) References Cited

U.S. PATENT DOCUMENTS 85,738 A * 1/1869 Gridley ..... A47G 1/16 248/489
1,805,937 A * 5/1931 Berge ..... A47G 3/00 411/372
4,601,624 A * 7/1986 Hill ..... F16B 37/14 411/373
5,513,935 A * 5/1996 Sharber ..... B44C 5/00 411/480
6,895,642 B2 * 5/2005 Huang ..... A47G 1/17 24/303
8,938,896 B2 * 1/2015 Spencer ..... A47G 3/00 40/209
9,181,969 B1 * 11/2015 Hiatt ..... F16B 23/0069
2005/0044673 A1 * 3/2005 Huang ..... F16M 13/022 24/303
2005/0045021 A1 * 3/2005 Berger ..... G10G 5/005 84/327

FOREIGN PATENT DOCUMENTS

DE 29610537 U1 * 10/1996 ..... A47G 3/00
GB 190117479 A * 10/1901

* cited by examiner

*Primary Examiner* — Robert Sandy
*Assistant Examiner* — Louis A Mercado
(74) *Attorney, Agent, or Firm* — Eric Hanscom

(57) ABSTRACT

A device to attractively cover the head of a nail or screw used to hang pictures and other items on a wall. The device has an attractive cover, a button cover attached to the back of the attractive cover, with a rotatable clasp section that can removably secure the head of a nail, screw, pin or other item. The button cover also has a magnet attached to its inside which helps secure the head of the screw, nail or pin.

14 Claims, 2 Drawing Sheets

DECORATIVE COVER FOR NAILS, TACKS AND SCREWS

CROSS REFERENCE TO RELATED APPLICATIONS

This application claims priority to U.S. Provisional No. 62818301, entitled Decorative cover for nails, tacks and screws, filed 14 Mar. 2019, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

Field of the Invention

This invention relates to wall art. More specifically, the present embodiments describe a decorative clasp device that easily slides over a screw, nail or tack and clasps shut to cover and embellish the screw/nail/tack and improve the aesthetic.

Brief Description of Invention

The goal of this invention is to provide an easy solution for covering unsightly screws, nails, tacks, holes in the wall, etc. to improve decorative aesthetic.

Creation of the problem this invention solves. Screws, nails and tacks have long been used to suspend and anchor art, photography, plants, etc. from a wall. Originally, their purpose was exclusively functional. However, when used to in conjunction with decorative works (such as suspended picture frames, macrame, weavings, etc.), the heads of screws/nails/tacks often ruin the aesthetic appearance intended by the creator of the work. In these situations, the aesthetic, as well as the utilitarian characteristics, of such screws/nails/tacks must be considered. Consequently, it became desirable to have a decorative embellishment that would easily attach to the anchor point (screw/nail/tack, etc.) to hide the screw/nail/tack. The proposed invention needed to be equally easy to remove and reuse due to ever-changing decor trends and shifts in personal style. Through the addition of the embellished cover over the screw/nail/tack, the suspended work is complemented and elevated to give it a finished look.

These decorative covers can also be used to simply hide an existing screw/nail/tack that has been abandoned in the wall so that the occupant of the space doesn't have to remove the hardware and patch the hole in the wall. Essentially, the decorative cover acts as a piece of art in and of itself while also hiding the unsightly screw/nail/tack.

The prior art has several examples of attempts to resolve this problem (prior art examples and why each doesn't work).

In an effort to serve this demand, decorative covers were developed. Early designs, however, had several disadvantages. Specifically, they were permanent fixtures, complex, limited in the variety of embellishment, made of numerous components, and, consequently, were expensive to manufacture and difficult to work with.

One such proposed solution is the decorative nail head cover as described in U.S. Pat. No. 5,513,935 to Sharber. Another proposed solution discloses a detachable ornamental head for nails and screws as described in application number GB 190117479 1901-08-31 to Vollert. Lastly, another proposed solution is a decorative screw as described by U.S. Pat. No. 9,181,969 B1 to Hiatt.

While the above-mentioned inventions do solve some of the disadvantages discussed, their application is limited. Specifically, neither cover is as secure or easily interchangeable as the proposed decorative screw/nail/tack cover. Additionally, Sharber's requires one flat edge on the cover so that it can be hammered into place. Once hammered into place it is not easily removed. Additionally, requiring a flat edge on the embellishment limits the variety of embellishments able to be used.

While Vollert's design functions the same as the proposed decorative screw/nail/tack cover, it is not nearly as secure as it is only secured by a forked clip or rubber washer, which again limits the variety of embellishments able to be used. For example, Vollert's invention likely would not hold an 8-ounce rock embellishment securely in place as there is no clasp system or magnet (for added reinforced security).

Hiatt's design does disguise and cover the screw, but requires extra tools to install and is not easily interchangeable.

Thus, there has existed a long-felt need for a simple low-cost alternative to enhance the decorative characteristics of a common screw/nail/tack used in decor while in no way diminishing from the utilitarian characteristics of the screw/nail/tack.

There are many interior decor aesthetics and styles and the proposed screw/nail/tack cover offers greater flexibility in useable materials, shapes and sizes for the embellishment to help coordinate and compliment any decor style. Additionally, the decorative cover can easily be removed/replaced to change up the aesthetic of a space. The following invention accomplishes these goals.

- The current invention provides by repurposing a button cover with hinged clasp to serve the purpose of covering a screw/nail/tack rather than a button. Button covers are ornamental in nature and are readily mountable and demountable and have a flat surface which adheres to ornament/embellishment of choice in conjunction with epoxy. A magnet is added between the clasp and hardware creating reinforced security to help hold the decorative cover against the screw/nail/tack.
- The proposed cover can be embellished with a host of decorative ornamentals including, but not limited to various rocks and minerals, wood shapes, ceramics art, rope, embroidered art, logos, etc. These decorative covers can appeal to many aesthetics and can be customized to meet many needs and purposes.
- The proposed decorative screw/nail/tack cover is an easy and cost-effective way to hide screws/nails/tacks holes unwanted holes in the wall, etc. through simply sliding the clasp opening over the screw/nail/tack post and clasping over the head. Attaching the decorative cover to an existing screw/nail/tack requires no additional tools from the user.

OBJECTS OF THE INVENTION

It is therefore an object of the present invention to provide a customizable and interchangeable decor solution to covering screws, nails, tacks, etc. to elevate their work and give it a finished look.

Additional objects of the invention include using the decorative cover to hide holes in a wall or other imperfections wanting to be hidden by the user to improve the aesthetic of their space.

Additional objects of the invention include using the decorative cover to act as a stand-alone piece of art.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
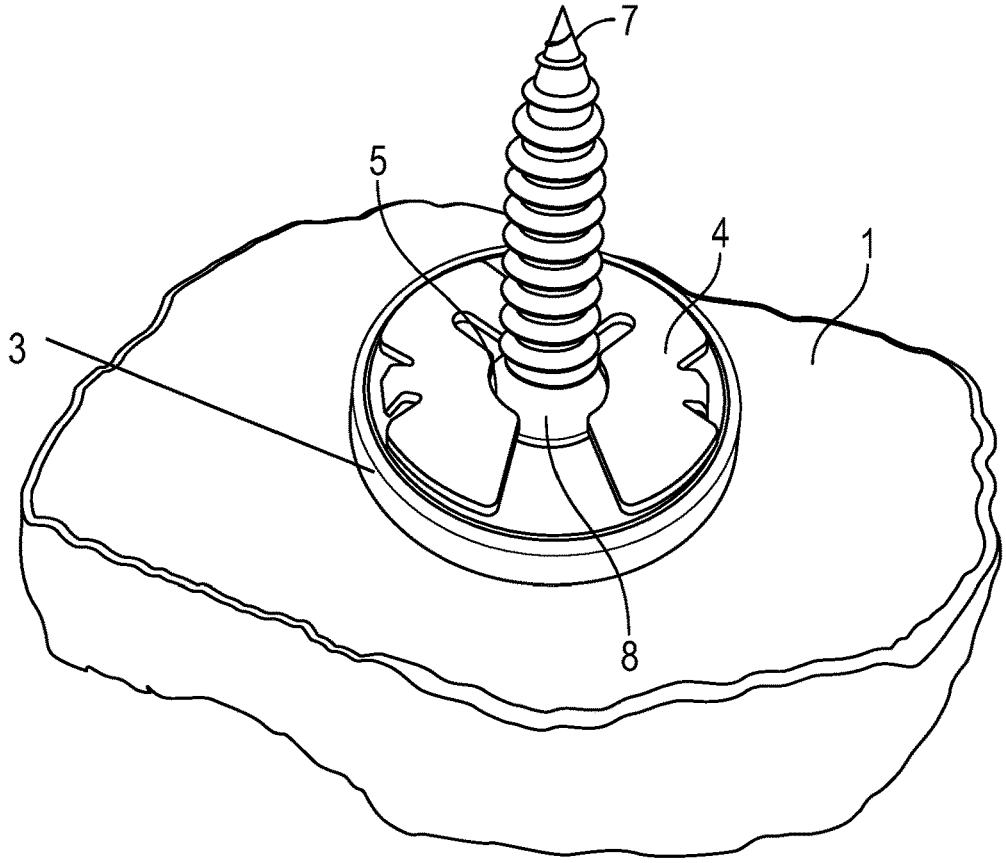
FIG. 1 is bottom perspective view of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is bottom perspective view of the invention. The screw, generally referenced as 7 also has a screw shaft diameter that is less than the diameter of the hole 5 in the clasp 4. The screw head 8, has a diameter that is greater than that of the hole 5 in the clasp, such that the head 8 of the screw 7 can be slid into the hole in the clasp, magnetically attracted by the magnet (not shown in the figure), and then the clasp can be rotated down to removably lock the invention over the nail head. The decorative cover 1 is attached to the button cover base 3

Figure 2:
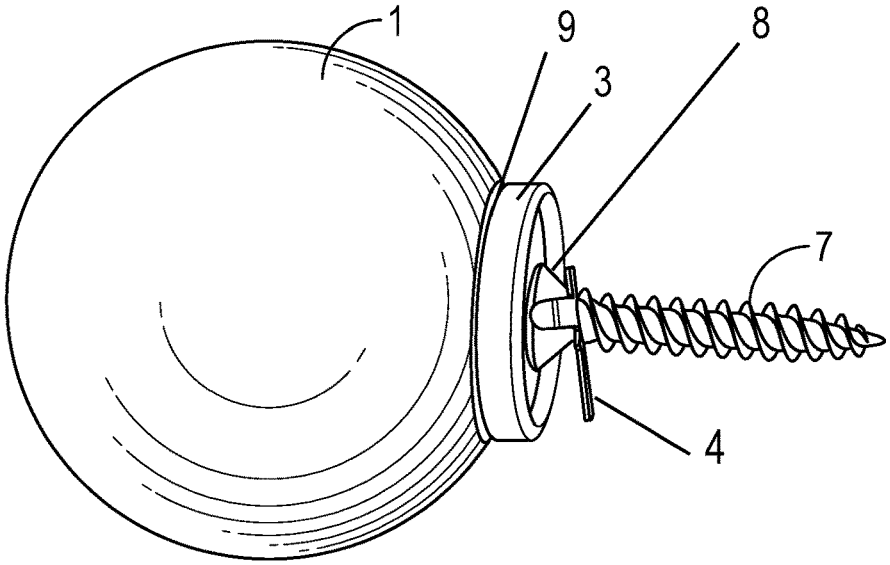
FIG. 2 is a side perspective view of the invention in a closed position over a screw head.

FIG. 2 is a side perspective view of the invention in a closed position over a screw head. The decorative cover 1, in this case a sphere of wood or another attractive material, is attached to the button cover base 3 at a point of attachment 9. Attachment is done by epoxy, glue, resin or another suitable material.

Figure 3:
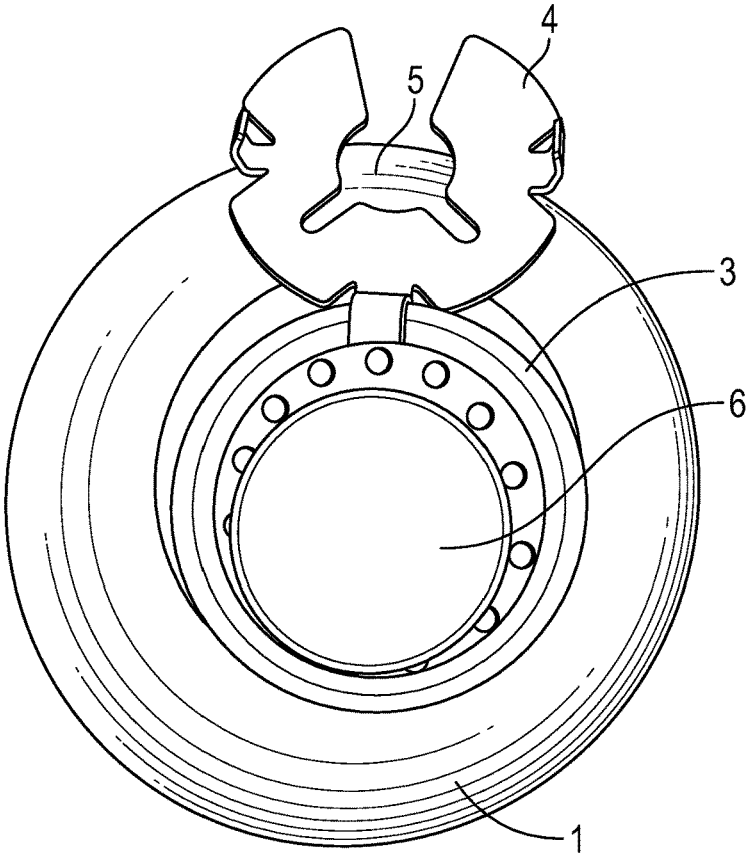
FIG. 3 is a back perspective view of the invention with its clasp pulled back.

FIG. 3 is a back perspective view of the invention with its clasp pulled back. The button cover clasp 4 has been pulled back to expose the magnet 6 in the button cover base 3. The magnet 6 serves to removably anchor a metal screw head or nail head to the invention. The clasp 4 and a hole 5 which is larger than the average diameter of the shaft of a screw or nail used for common household purposes such as hanging pictures. The button cover base 3 is adhered to the back of the decorative cover 1 by epoxy or another common adherent.

Figure 4:
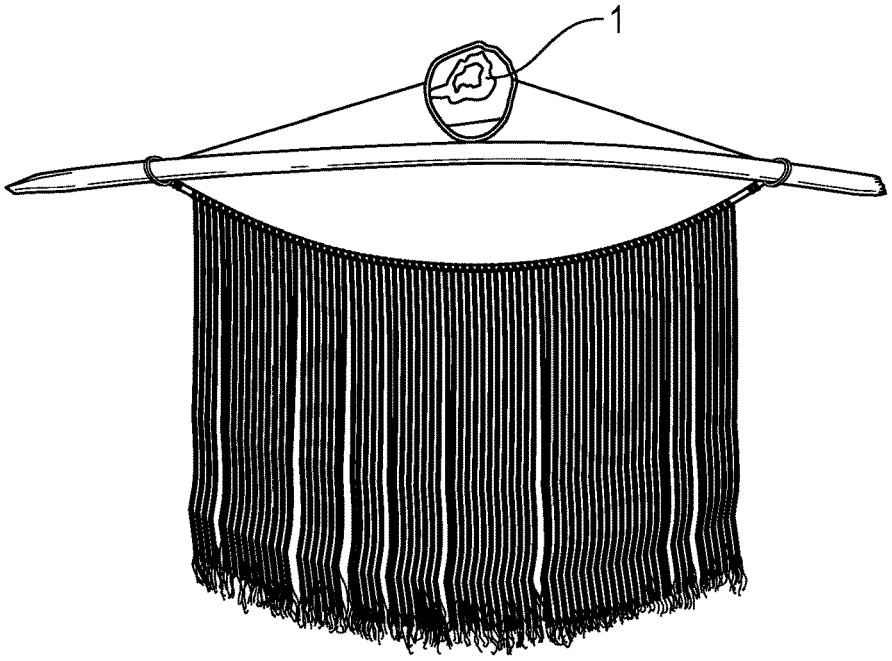
FIG. 4 is a front view of a wall hanging with a covered screw head.

FIG. 4 is a front view of a wall hanging with a covered screw head. A decorative cover 1, covers the screw or nail from which the wall decoration hangs.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMBERS USED

1. Decorative Cover
2. Button cover (generally)
3. Button cover base
4. Button cover clasp
5. Button cover hole
6. Magnet
7. Screw, generally
8. Screw head
9. Attachment point

I claim:

1. A device for decoratively covering a head of a fastener used to hang an item on a wall, consisting of: a decorative cover, a button cover, and a magnet, where the magnet is attached to the button cover, and where the button cover is attached to the decorative cover at a point of attachment, where the button cover can be slipped over a head of a hanger protruding from a wall, such that the button cover hangs from the head, and where the head is covered by the decorative cover, where the decorative cover comprises a front surface and a back surface, where the front surface has a decorative element, where the button cover has a button cover base and a clasp, where the clasp is rotably attached to the button cover base, where the button cover base removably mates with the clasp to removably secure the clasp to the button cover base, where the button cover base is adhered to the back surface of the decorative cover by an adherent, where the adherent is epoxy, where the button cover additionally comprises the magnet, where the button cover base has a top side and a bottom side, where the bottom side is attached to the back surface of the decorative cover, and where the magnet is permanently attached to the top side of the button cover base, where the clasp of the button cover additionally comprises a hole, where the hole has a hole diameter, and where the hole diameter is larger than a fastener shaft diameter, but less than a fastener head diameter, such that the clasp can be placed over a fastener shaft such that the fastener shaft rests in the hole, and the clasp is closed over the head of the fastener, thereby retaining it in the button cover base, where the fastener is a screw.

2. A device for decoratively covering a head of a fastener used to hang an item on a wall, comprising: a decorative cover, a button cover, and a magnet, where the magnet is attached to the button cover, and where the button cover is attached to the decorative cover at a point of attachment, where the button cover can be slipped over a head of a hanger such that the button cover hangs from the head, and where the head is covered by the decorative cover, where the decorative cover comprises a front surface and a back surface, where the front surface has a decorative element, where the button cover has a button cover base and a clasp, where the clasp is rotably attached to the button cover base, where the button cover base removably mates with the clasp to removably secure the clasp to the button cover base.

3. The device of claim 2, where the button cover base is adhered to the back surface of the decorative cover by an adherent.

4. The device of claim 3, where the adherent is epoxy.

5. The device of claim 3, where the button cover additionally comprises the magnet.

6. The device of claim 5, where the button cover base as a top side and a bottom side, where the bottom side is attached to the back surface of the decorative cover, and where the magnet is permanently attached to the top side of the button cover base.

7. The device of claim 6, where the clasp of the button cover additionally comprises a hole, where the hole has a hole diameter, and where the hole diameter is larger than a fastener shaft diameter, but less than a fastener head diameter, such that the clasp can be placed over a fastener shaft such that the fastener shaft rests in the hole, and the clasp is closed over the head of the fastener, thereby retaining it in the button cover base.

8. The device of claim 7, where the fastener is a screw.

9. The device of claim 6, where the button cover clasp additionally comprises a hole, where the hole has a hole diameter, and where the hole diameter is larger than a screw shaft diameter, but less than a screw head diameter, such that the clasp can be placed over a screw shaft such that the screw shaft rests in the hole, and the clasp is closed over a head of a screw, thereby retaining it in the button cover base.

10. The device of claim 6, where the clasp of the button cover additionally comprises a hole, where the hole has a hole diameter, and where the hole diameter is larger than a nail shaft diameter, but less than a nail head diameter, such that the clasp can be placed over a nail shaft such that the nail shaft rests in the hole, and the clasp is closed over a head of a nail, thereby retaining it in the button cover base.

11. The device of claim 6, where the decorative element is selected from the group consisting of wood, ceramic, glass, stained glass, minerals, rocks, gems, jewels, metals, fiber, resin, pressed flowers, shells, paper, feathers, preserved insects, bones, paper, concrete, acrylic and plastic.

12. The device of claim 6, where the decorative element can vary in shape, size, texture, color and weight.

13. A device for decoratively covering a head of a fastener used to hang an item on a wall, comprising: a decorative cover, a button cover, and a magnet, where the magnet is attached to the button cover, and where the button cover is attached to the decorative cover at a point of attachment, where, the button cover can be slipped over a head of a hanger protruding from a wall, such that the button cover hangs from the head, and where the head is covered by the decorative cover, where the decorative cover comprises a front surface and a back surface, where the front surface has a decorative element, where the button cover has a button cover base and a clasp, where the clasp is rotably attached to the button cover base, where the button cover base removably mates with the clasp to removably secure the clasp to the button cover base, where the button cover base is adhered to the back surface of the decorative cover by an adherent.

14. The device of claim 13, where the adherent is epoxy, where the button cover additionally comprises the magnet, where the button cover base as a top side and a bottom side, where the bottom side is attached to the back surface of the decorative cover, and where the magnet is permanently attached to the top side of the button cover base, where the clasp of the button cover additionally comprises a hole, where the hole has a hole diameter, and where the hole diameter is larger than a fastener shaft diameter, but less than a fastener head diameter, such that the clasp can be placed over a fastener shaft such that the fastener shaft rests in the hole, and the clasp is closed over the head of the fastener, thereby retaining it in the button cover base, where the fastener is a screw.

* * * * *